US007946895B2

(12) United States Patent
Hain et al.

(10) Patent No.: US 7,946,895 B2
(45) Date of Patent: May 24, 2011

(54) INTERNALLY THREADED NUT WITH A COLLAR HELD CAPTIVE IN A NUT HOLDING SECTION

(75) Inventors: Jochen Hain, Eschenburg-Wissenbach (DE); Reinhold Opper, Buseck (DE)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 12/909,366

(22) Filed: Oct. 21, 2010

(65) Prior Publication Data

US 2011/0065335 A1 Mar. 17, 2011

Related U.S. Application Data

(63) Continuation of application No. PCT/US2009/039741, filed on Apr. 7, 2009.

(30) Foreign Application Priority Data

Apr. 21, 2008 (DE) ..... 10 2008 021 303

(51) Int. Cl.
*H01R 11/03* (2006.01)

(52) U.S. Cl. ..... 439/793

(58) Field of Classification Search ..... 439/793, 439/801, 810, 727, 813
See application file for complete search history.

(56) References Cited

U.S. PATENT DOCUMENTS

| | | | | |
|---|---|---|---|---|
| 3,928,079 | A | 12/1975 | Jennings et al. | |
| 5,092,723 | A | 3/1992 | Compton et al. | |
| 5,192,234 | A | 3/1993 | Heng et al. | |
| 5,314,360 | A | 5/1994 | Jaag | |
| 5,442,133 | A | 8/1995 | Arnold et al. | |
| 6,010,360 | A | 1/2000 | Ohai | |
| 6,027,382 | A * | 2/2000 | Reindl et al. | 439/793 |
| 6,042,431 | A * | 3/2000 | Hayakawa | 439/801 |
| 6,079,923 | A * | 6/2000 | Ross et al. | 411/353 |
| 7,296,830 | B2 | 11/2007 | Koveal et al. | |
| 2002/0171395 | A1 | 11/2002 | Streuer | |
| 2003/0040217 | A1 | 2/2003 | Renne et al. | |
| 2008/0118325 | A1 * | 5/2008 | Opper et al. | 411/103 |
| 2009/0137160 | A1 * | 5/2009 | Opper et al. | 439/727 |

FOREIGN PATENT DOCUMENTS

| | | | |
|---|---|---|---|
| DE | 7821308 | U1 | 12/1979 |
| DE | 102006056065 | A1 | 5/2008 |

* cited by examiner

*Primary Examiner* — Chandrika Prasad
(74) *Attorney, Agent, or Firm* — Michael P. Leary

(57) ABSTRACT

The invention relates to a contact-making arrangement for establishing an electrical contact, having a nut which has an internally threaded section, and having a holding part for holding captive the nut and at least one connecting part such as a cable lug, with the nut having a collar section which projects radially beyond a base body of the nut, with the holding part having a holding section for the nut, into which the nut can be inserted in a first axial direction, and with the holding part having first latching means which are designed to engage behind the collar section of a nut which has been inserted into the nut holding section.

17 Claims, 4 Drawing Sheets

INTERNALLY THREADED NUT WITH A COLLAR HELD CAPTIVE IN A NUT HOLDING SECTION

CROSS-REFERENCE TO RELATED APPLICATIONS

This application is a continuation of PCT Application No. PCT/US2009/039741, filed Apr. 7, 2009 which claims the benefit of German Patent Application No. 102008021303.9, filed Apr. 21, 2008.

BACKGROUND OF THE INVENTION

The present invention relates to a contact-making arrangement and to a preassembled contact-making unit of a contact-making arrangement such as this, which has a nut and a holding unit.

The present invention also relates to a nut for a contact-making arrangement such as this, and to a method for forming an electrical contact between at least one connecting part such as a cable lug and a contact substrate such as a workpiece.

In general, the present invention relates to the field of so-called earth contacts, such as those which are used widely in particular in motor vehicle engineering. In order to make a robust earth contact, a bolt or a nut is welded to a metal sheet of the vehicle bodywork, so that the bolt or the nut is electrically conductively connected to the metal sheet. A connecting part such as a cable lug is then electrically connected to the bolt or to the nut, by screwing a nut onto the bolt or by screwing a screw into the nut.

One general problem in this case is that a painting process is carried out between the bolt (nut) being welded on and the connecting part (cable lug) being fixed. In order to keep the contact surfaces free of paint in order to make an electrical connection, it is known for these contact sections to be covered. The covering parts which are used for this purpose are in this case thrown away before the connecting part is fixed. It is known from the document EP 0 641 944 A1 for a nut to be used as the covering part, which is also then used once again to attach the connecting part. There is therefore no need to throw a part away. However, the overall assembly process is somewhat more complex.

It is known from German patent application 10 2006 056065.5 for a bolt with an axial blind hole to be welded to a metal sheet. In this case, the bolt with the blind hole has a first threaded section in the blind hole, which first threaded section is covered by a covering part and in particular a plug, which is relatively short and is inserted into the blind hold from above. A cable lug is pushed onto a screw with a second threaded section, and the screw is screwed into the blind hole. During this process, the plug is forced downwards to the base of the blind hole. At least one threaded section of the two threaded sections may be in the form of a self-tapping threaded section. In consequence, an electrical contact is made in this way between the cable lug and the lower face of a head of the screw, and via the self-tapping threaded engagement between the screw and the bolt with the blind hole, and in consequence with the metal sheet to which the bolt with the blind hole is welded.

In this case, it is also known from the cited German patent application for at least one cable lug to be inserted into a holding unit in the radial direction, and for a screw then to be inserted into the holding unit. In this case, the shank of the screw passes through the hole in the cable lug, and latching means being engaged behind the head of the screw. This results in a preassembled attachment arrangement which has the holding part, the screw and at least one cable lug that has been threaded onto the screw. Since the screw passes through the hole in the cable lug, this prevents the cable lug from being pulled out of the holding unit radially. In addition, further latching means may be provided in order to prevent the screw from falling out of the holding part. In one particular embodiment, in the case of a holding part, apart from radial holes for cable lugs to be inserted into it from the side, provision is also made for a further cable lug to be forced into the holding device from underneath in the axial direction onto the preassembled attachment arrangement, comprising the holding part, the screw and the at least one cable lug. This particular embodiment can be used as follows. The preassembled attachment arrangement described above can be fitted in advance to a cable harness. In this case, for example, one or more cable lugs can be inserted into the holding unit from the side thereof and the screw can then be passed through in order to hold both the screw and the cable lugs captive on the holding unit. During fitting of the cable harness, one or more further cable lugs can then be inserted into the holding part from underneath, that is to say in the longitudinal direction, retrospectively in situ, and can be pushed onto the screw before the screw is screwed into a bolt with a blind hole as described above (earth bolt).

German patent application 10 2007 057 082.3 discloses a preassembled contact-making unit having a screw which has a head and a shank, and having a holding unit, with the holding unit having a connecting part holding section into which at least one connecting part can be inserted, and has a screw holding section into which the screw is inserted in the longitudinal direction, such that the screw is held captive in the longitudinal direction, but can rotate, and in which case a connecting part which is inserted into the connecting part holding section can make electrical contact with the inserted screw, with a radially projecting contact section being formed on the head and with the screw holding section having a shoulder section by means of which the contact section is supported axially on the holding unit.

BRIEF SUMMARY OF THE INVENTION

Against the above background, the object of the invention is to specify an improved system for provision of an earth connection, as well as arrangements and methods which can be used for this purpose.

The above object is achieved by a contact-making arrangement for establishing an electrical contact, having a nut which has an internally threaded section, and having a holding part for holding captive the nut and at least one connecting part such as a cable lug, with the nut having a collar section which projects radially beyond a base body of the nut, with the holding part having a holding section for the nut, into which the nut can be inserted in a first axial direction, and with the holding part having first latching means which are designed to engage behind the collar section of a nut which has been inserted into the nut holding section.

Furthermore, the above object is achieved by a preassembled contact-making unit having a nut and a holding part of a contact-making arrangement such as this, and by a nut for a contact-making arrangement such as this.

Furthermore, the above object is achieved by a method for forming an electrical contact between at least one connecting part such as a cable lug and a bolt, which has a shank with an external thread and is connected to a contact substrate such as a metal sheet, having the following steps:

provision of a preassembled contact-making unit which has a holding part on which a nut and the at least one connecting part are held captive, in particular a preassembled contact-making unit of the abovementioned type, into which the connecting part is additionally inserted;

fitting of the contact-making unit to the bolt such that the shank of the bolt passes through an opening in the connecting part;

screwing the nut onto the bolt, with an electrical contact being made between the connecting part and the bolt, and with the holding part remaining on the contact formed in this way.

The measures according to the invention make it possible to prefabricate a contact-making unit in which the nut is held captive on the holding part. A connecting part such as a cable lug (or a plurality of such connecting parts) can then be inserted into the holding part at the location where the cable harness is being fabricated. The cable harness that is being prefabricated in this way can then be tested in advance relatively easily, before the cable harness is fitted at a final assembly point. During transportation of the prefabricated cable harness to the final assembly point, the nut and the connecting part or parts are held captive on the holding part and in consequence on the cable harness. During final assembly, all that is then necessary is to place the preassembled contact-making unit with the connecting part inserted onto a bolt, and to screw it on, in which case the holding part can remain on an electrical contact that has been formed in this way.

This allows the final assembly process to be simplified. Furthermore, it is possible to avoid the process of fitting a connecting part to the bolt at the final assembly point being forgotten. However, in some embodiments, it is also possible before final assembly to also insert one or more further connecting parts into the holding part, before the nut is screwed to the bolt.

The threaded sections of the nut and bolt may be conventional threads such as metric threads. In some embodiments, a threaded section may be in the form of a self-tapping threaded section, in which case the other component (for example the bolt) has a threaded section which can be tapped and has a smooth surface before the nut is screwed on.

The holding part can also be designed to engage with the bolt in such a manner as to provide protection against rotation. Alternatively or in addition to this, it is also possible to design a screwdriver such that it grips radially projecting sections of the connecting parts, and in this way provides protection against rotation during screwing-on.

Furthermore, a protective cap can be fitted to the bolt before the nut is screwed on and prevents a threaded section of the bolt from being painted in a time period between the bolt being joined to the contact substrate (for example a metal sheet) and final assembly of the cable harness (which could reduce the contact-making capability).

As an alternative to this, it is also possible to dispense with a cap such as this (which, for example, may be in the form of a nut), particularly when one of the threaded sections of the nut or bolt is in the form of a threaded section which can be tapped. This is because, in this case, a metallic and in consequence electrically conductive contact between the nut and the bolt can also be provided by the tapping thread engagement, even when the bolt has already been painted.

When using a tapping threaded section, process monitoring can also be carried out, by monitoring a torque that is applied while the nut is being screwed on in order in this way to find out whether the correct number of connecting sections have been inserted between the nut and the bolt for a respective electrical contact.

Details relating to the tapping thread engagement and the process monitoring which can be provided in this way, as well as details relating to a tool for provision of rotation protection while being screwed on are disclosed in German patent application DE 10 2007 057 082.3, to whose entire contents reference is hereby made.

One particular advantage of the contact-making arrangement according to the invention is for the holding part to have a connecting part holding section with an annular body, from which at least two longitudinal webs extend in the axial direction, and define radial openings between them.

The radial openings can be used for line sections of the connecting parts to pass through.

In this case, it is particularly advantageous for the connecting part holding section to have second latching means in order to hold captive a connecting part which has been inserted into the connecting part holding section. It is particularly advantageous for the second latching means to be formed on at least one of the longitudinal webs.

This allows the second latching means for holding the connecting part captive to be designed to be particularly simple.

By way of example, the second latching means may have a latching web which extends radially inwards from a longitudinal web.

When using second latching means such as these, the connecting part can in general simply be clipped into the holding part, and it is then held captive therein.

According to a further preferred embodiment, the annular body has at least one axial slot which extends from an axial end into the annular body, which is opposite to an axial end from which the longitudinal webs extend.

This allows the annular body of the holding part to expand in the radial direction, in order to make it easier to insert the nut and/or the connecting part.

In one particularly preferred embodiment, the holding part has a connecting part holding section which is formed separately from the nut holding section.

This embodiment makes it possible to insert connecting parts into the holding part independently of whether a nut has or has not already been inserted into it.

This embodiment makes it possible, in particular, to provide a preassembled contact-making unit in which a nut has already been inserted into the holding part and in which connecting parts can subsequently be inserted into the holding part.

In this case, it is particularly advantageous for the connecting part holding section and the nut holding section to be separated from one another by a shoulder section which acts as a stop for the nut and/or the connecting part.

In this embodiment, the different holding sections are separated from one another in the axial direction, with the shoulder section acting as a stop to hold the nut and/or the connecting part in a latching form.

In this case, it is also advantageous for the nut to have an abutment section which rests circumferentially on a radial inner surface of the shoulder section.

In this embodiment, the radial contact between the abutment section and the radial inner surface of the shoulder section of the holding part make it possible to hold the nut concentrically and in a stable form with respect to the holding part In this embodiment, a preassembled contact-making unit comprising a nut and a holding part can be designed to be particularly robust so that, even when external forces act on it, this ensures that the nut does not become loose from the holding part.

Overall, it is also advantageous for the nut to have a centring section which extends axially into a connecting part holding section.

In this embodiment, it is possible for connecting parts which have been inserted into the holding part to be centred by means of the centring section, by the centring section passing through a contact opening in the connecting part.

In particular, this embodiment makes it easier to screw the nut onto the bolt since there is no need for the connecting parts to be pushed onto the bolt, which is comparatively tedious.

It is particularly preferable for the centring section to be formed integrally with the base body of the nut.

In this embodiment, the axial length of the centring section is preferably matched to the number of connecting parts to be connected to the electrical contact.

According to an alternative embodiment, the centring section is formed by a centring element which is separate from the nut and is mounted on the nut such that it can move axially.

In this case, the centring element can, for example, be pressed into an opening in the nut such that the centring element is held captive, but can move axially with respect to the nut when screwed onto the bolt.

In this embodiment, the centring element may be designed for different numbers of connecting parts. If less than the maximum number of connecting parts are inserted before the nut is screwed on, the centring element is pressed in an appropriate form while the nut is being screwed on, thus making it possible to produce a secure electrical contact.

In this case, the centring element may preferably be in the form of a sleeve element which is inserted into a hole in the nut such that it can move axially therein.

A sleeve element such as this may be designed for its external circumference to act as a centring means for the central opening of a connecting part. The internal circumference of the connecting part can be designed to surround the bolt.

Although the above description has been based on the centring section being designed to be inserted into openings in the connecting parts in order to produce the centring effect, it is also possible to design the centring section such that it acts on the external circumference of the connecting parts (or of the connecting part).

Overall, it is also advantageous for it to be possible to introduce the connecting part into the holding part in an axial direction which is opposite the first axial direction.

In this embodiment, it is possible for the connecting parts to be inserted into the holding part once the nut has already been mounted captive on the holding part.

Furthermore, overall, it is advantageous for the holding part to have an annular body at whose internal circumference the first latching means extend, which serve to hold the nut on the holding part in a latching form.

According to an alternative embodiment, the nut holding section is also forming a connecting part holding section.

In this case, the first and the second latching means may be formed by one and the same latching means.

In this embodiment, it is possible to first of all insert one or more connecting parts into the holding part and then to insert the nut into the holding part, such that a preassembled contact-making unit contains the holding part, the nut and one or more connecting parts, from the start.

In this case, it is preferable for the holding part to have a base section with an axial opening, with the connecting part and the collar section of the nut being held captive between the base section and the latching means.

Overall, depending on the embodiment, the invention makes it possible to achieve at least one of the abovementioned advantages.

If the preassembled contact-making unit comprises the holding part and the nut, this makes it possible to reduce the amount of work required both for fabrication of the cable harness and for final assembly. When using a preassembled contact-making unit into which connecting parts have already been inserted, this makes it possible at least to reduce the amount of work required for final assembly of the cable harness.

Since, in some embodiments, connecting parts can also be inserted retrospectively, this once again makes it possible to simplify final assembly.

In general, the position and the correct quantities of connecting parts on the holding part can be checked in advance. This allows electrical prior testing of the cable harness.

Since the nut is held captive in the holding part, this makes it possible to reduce transport damage. The storage costs are likewise reduced.

It is self-evident that the features mentioned above and those which are still to be explained in the following text can be used not only in the respectively stated combination but also in other combinations or on their own without departing from the scope of the present invention.

BRIEF DESCRIPTION OF THE SEVERAL VIEWS OF THE DRAWINGS

Exemplary embodiments of the invention will be explained in more detail in the following description, and are illustrated in the drawing, in which.

DETAILED DESCRIPTION OF THE PREFERRED EMBODIMENTS

Figure 1:
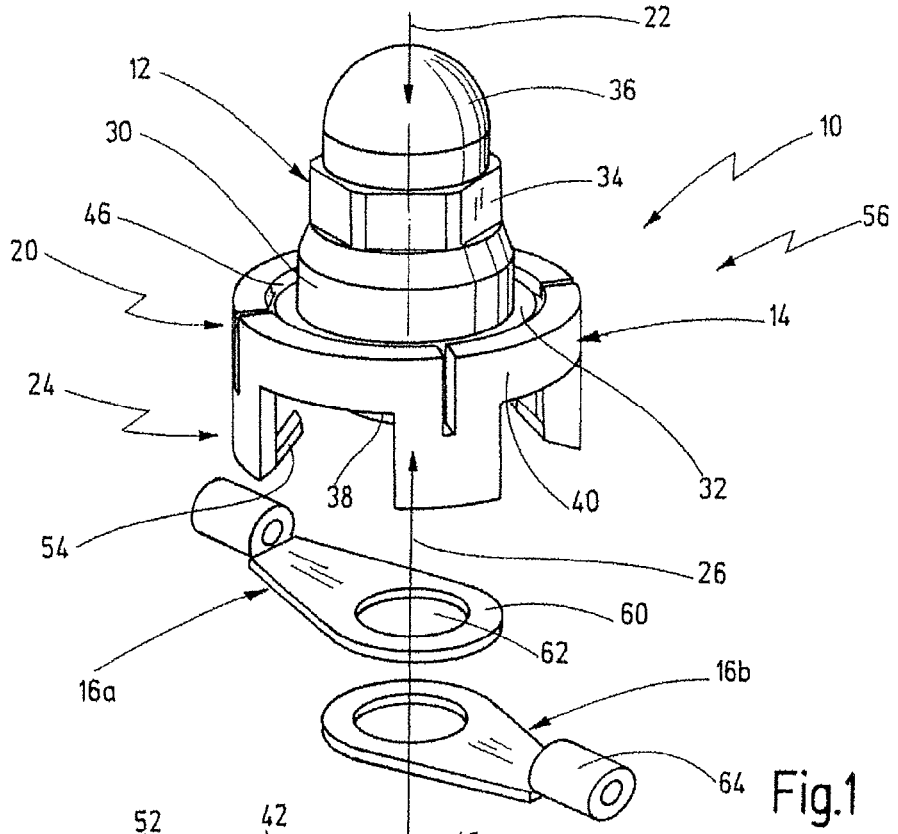
FIG. 1 shows a perspective illustration of a first embodiment of a contact-making arrangement according to the invention.

In FIG. 1, a first embodiment of a contact-making arrangement according to the invention is generally annotated 10. The contact-making arrangement 10 has a nut 12 and a holding part 14, which form a preassembled contact-making unit 56. In this case, the nut 12 is held captive on the holding part 14. Furthermore, the contact-making arrangement 10 contains one or more connecting parts 16, in the present case two connecting parts 16*a*, 16*b*. The connecting parts 16 are each in the form of cable lugs. The contact-making arrangement 10 is used to make an electrical contact between the cable lugs 16 and a contact substrate or workpiece that is not illustrated, such as a metal sheet to which a bolt is joined. The contact-making unit 56 comprising the nut 12 and the holding part 14 is designed for the connecting parts 16 first of all also to be inserted into the holding part 14 and then for the contact-making arrangement 10 which has been completed in this way to be screwed to the bolt. This results in an electrical contact being made between the connecting parts and the bolt and/or the contact substrate via the nut 12.

The holding part 14 has a nut holding section 20 into which the nut 12 can be inserted such that it is held captive, to be precise in a first axial direction 22. Furthermore, the holding part 14 has a connecting part holding section 24 into which the at least one connecting part 16 can be inserted, to be precise in a second axial direction 26, which is opposite the first axial direction.

As stated, in the case of the contact-making arrangement 10, the nut 12 and the holding part 14 form the preassembled contact-making unit 56 once the nut 12 has been inserted into the nut holding section 20 in the first axial direction 22. One or more connecting parts 16 can then be inserted into the connecting part holding section 24 from the second direction 26. This can be done by the cable fabricator, and results in the contact-making arrangement 10 becoming an integral component of a cable harness. Furthermore, after being transported to the final assembly point, one or more connecting parts 16 can be inserted there into the connecting part holding section 24 before the nut 12 is screwed to the bolt, which is not illustrated, in order to make the electrical contact.

The nut 12 has a generally cylindrical base body 30 which is formed with an internally threaded section, that is not illustrated in FIG. 1. Furthermore, the nut 12 has a collar section 32 which projects like a ring with respect to the base body 30 in the radial direction. The collar section 32 is held in the nut holding section 20 in a latched manner. The base body 30 extends from the holding part 14 in the axial direction. A tool attachment section 34 in the form of a hexagonal section is formed in an upper area of the base body 30, which extends outside the holding part 14. Above the tool attachment section 34, the nut has a closure cap 36 which may be in the form of a separate component and covers the internally threaded section, which is not illustrated. In the present case, however, the closure cap 36 is formed integrally with the base body 30.

Furthermore, the nut 12 contains a centring section 38 which is arranged underneath the collar section 32, that is to say axially opposite the tool attachment section 34. The centring section 38 extends into the connecting part holding section 24, such that the connecting parts 16 can be centred axially in the connecting part holding section 24 by means of the centring section 38.

The connecting parts 16 each have a contact section 60 which is in the form of an eye with a central contact opening 62. Furthermore, a line section 64 in each case extends from the contact section 60 and can be connected to an electrical line or the like.

Figure 2:
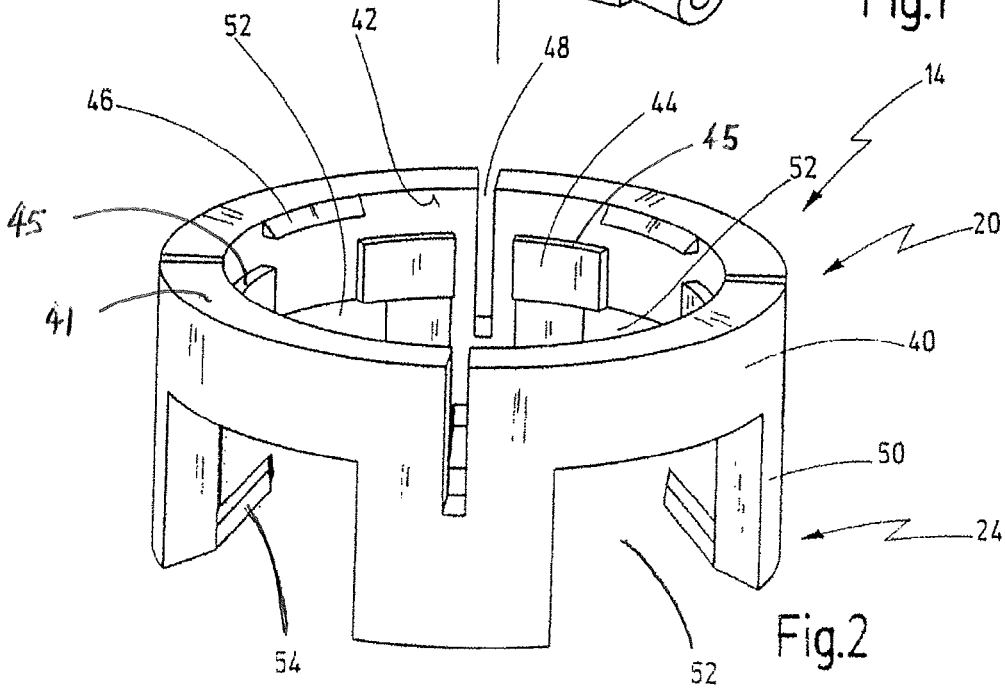
FIG. 2 shows a perspective illustration of the holding part of the contact-making arrangement shown in FIG. 1.

The holding part 14 is shown more accurately in FIG. 2. It contains an annular body 40 with a central axial opening 42. A shoulder section 44 is formed on the internal circumference of the annular body 40 and extends inwards in the radial direction into the axial opening 42, that is to say it projects from the internal circumference of the annular body 40. In the present case, the shoulder section 44 is formed by a plurality of projections, which project from the internal circumference of the annular body 40. The shoulder section 44 is designed such that the collar section 32 of the nut 12 can be supported in the axial direction on an upper face 45 of the shoulder section 44. In consequence, this area of the shoulder section 44 forms a part of the nut holding section 20. Furthermore, a plurality of latching tabs 46 are formed on the internal circumference of the annular body 40, and form first latching means. The latching tabs 46 are formed on the internal circumference of the annular body 40 in the immediate vicinity of an upper face 41 of the annular body 40, that is to say of an upper face of the holding part 14. The latching tabs 46 are separated from the upper face of the shoulder section 44 by a distance which corresponds to the axial depth of the collar section 32. When the nut 12 is inserted into the nut holding section 20, the collar section 32 is pushed past the latching tabs 46 until the collar section 32 rests on the upper face 45 of the shoulder section 44, and the latching tabs 46 engage behind an upper face 33 of the collar section 32, as is illustrated in FIG. 1. In this state, the nut 12 is connected in a captive manner to the holding part 14.

In order to make it easier to insert the nut 12, one or more axial slots 48 is or are provided on the base body 30, allowing or making it easier to widen the annular body 40 radially.

The connecting part holding section 24 of the holding part 14 contains two or more (four in the illustrated case) longitudinal webs 50, which extend from a lower face 39 of the annular body 40 in the axial direction. Radial openings 52 are formed between the longitudinal webs 50. In this case, the radial openings 52 are used to pass one or more of the line sections 64 out of the connecting part holding section 24 in the radial direction.

A latching web 54 projects from each inner face of the longitudinal webs 50. The latching webs 54 form second latching means. The latching webs 54 extend obliquely inwards from an end of the longitudinal webs 50, such that the contact sections 60 of the connecting parts 16 can be pushed into the connecting part holding section 24 in the second axial direction 26. During this process, the latching webs 54 are deformed radially outwards, until they snap back and engage radially behind the contact section 60. This allows one or more connecting parts 16 to be held captive in the connecting part holding section 24.

Figure 3:
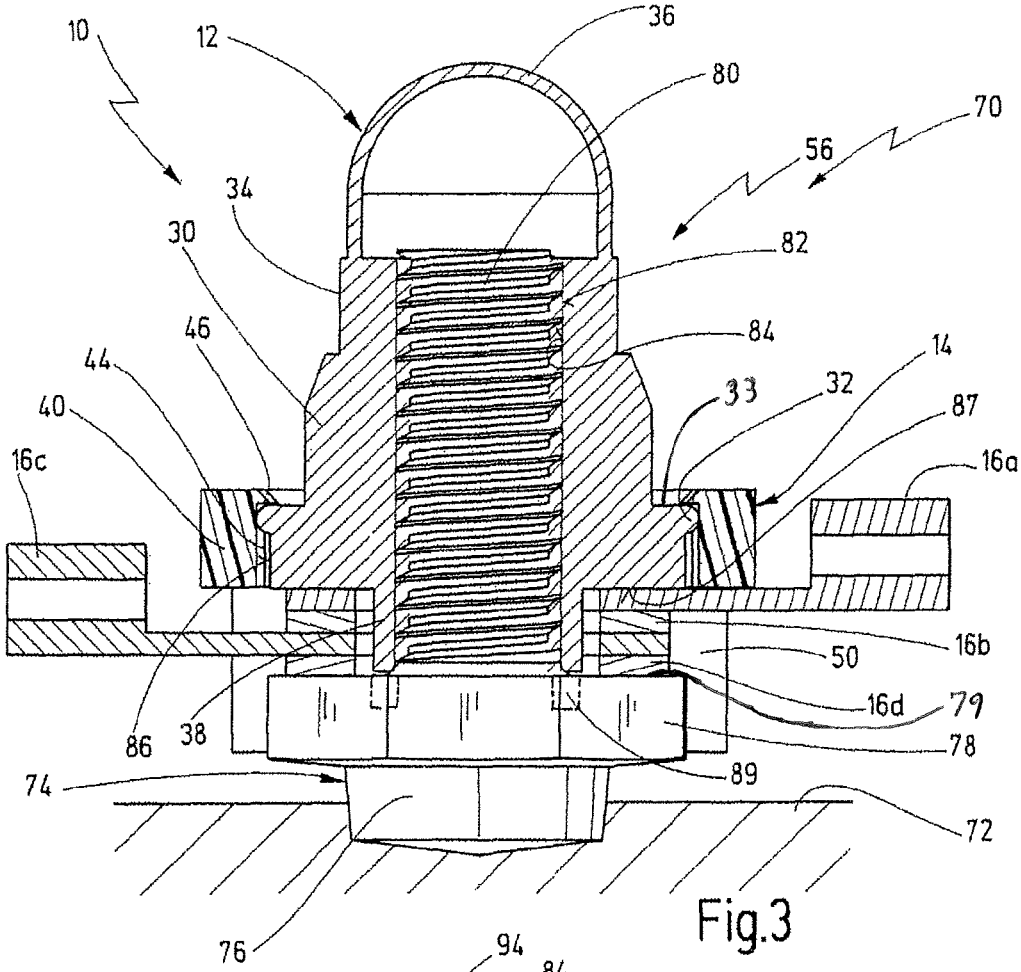
FIG. 3 shows a longitudinal section viewed through an electrical contact which has been made by means of a contact-making arrangement according to the invention, as shown in FIG. 1.

FIG. 3 shows an electrical contact, which has been completed by means of the contact-making arrangement 10, in the form of an earth contact 70.

A bolt (or stud) 74 is joined to an electrical contact substrate or earth substrate 72 in the form, for example, of a metal sheet, such as a bodywork metal sheet, to be precise in such a manner that it is rigidly connected to the contact substrate 72 and projects at right angles from it. By way of example, the bolt 74 may be connected to the contact substrate 72 during the course of so-called stud welding. The bolt 74 has an attachment section 76, at which the bolt 74 is connected to the contact substrate 72, for example in the form of a solidified weld melt. The bolt 74 also has a flanged section 78 which is a distance from a surface of the contact substrate 72, with its external circumference being in the form, for example, of a polygonal section (for example an octagonal or hexagonal section). Furthermore, the bolt 74 has a shank section 80 which extends above the flanged section 78 and has an externally threaded section 82.

FIG. 3 also shows the internally threaded section 84 of the nut 12, into which the externally threaded section 82 of the bolt 74 is screwed.

The nut 12 has an abutment section 86 axially underneath the collar section 32, the external circumference of which abutment section 86 is matched to the internal circumference of the shoulder section 44. When the collar section 32 has been latched in the first latching means 46, the abutment section 86 rests flush on the shoulder section 44 and ensures that the preassembled contact-making unit 56 is aligned axially, that is to say the nut 12 is fixed axially rigidly with respect to the holding part 14.

Axially underneath the abutment section 86, the nut 12 has a radially aligned contact section 87 on which a connecting part 16 rests, as the first item that has been inserted into the connecting part holding section 24, to be precise with its contact section 60 resting there. The contact section 87 merges into the centring section 38, which extends in the form of a sleeve around the bolt 74 in the axial direction, and passes through the contact openings 62 in the connecting parts 16. In the illustrated earth contact 70, four connecting parts 16*a-d* are held in the connecting part holding section 24, with the uppermost connecting part 16*a* resting against the contact section 87. The lowermost connecting part 16*d* rests on an upper face 79 of the flanged section 78 of stud 74.

The centring section 38 is formed integrally with the base body 30 of the nut 12, and its axial length is matched to the number of connecting parts 16 with which contact is to be made. To be more precise, the axial length of the centring section 38 is somewhat less than the sum of the axial thicknesses of the contact sections 60 of the connecting parts 16*a-d* which are part of the earth contact 70. This ensures that the connecting parts 16*a-d* can be compressed between the upper face of the flanged section 78 and the contact section 87, to be precise as a result of the thread engagement of the threaded sections 82, 84.

As an alternative to this, it is possible to provide an annular depression 89 on the upper face 79 of the flanged section 78, as illustrated by dashed lines in FIG. 3. In this case, a variable number of connecting parts 16 can be used to form the earth contact 70, since the centring section 38 can enter the annular depression 89 when fewer than the maximum number of connecting parts 16 are fitted.

On the one hand, an electrical contact can be established directly between the connecting parts 16 and the contact substrate 72 by the connecting parts 16 touching one another and touching the upper face of the flanged section 78. The bolt 74 is in this case designed in precisely the same way as the contact sections 60 from an electrically conductive material such as metal, thus making it possible to form an electrical connection to the contact substrate 72 (which in general is likewise produced from an electrically conductive material).

In some cases, the flanged section 78 will, however, have been painted before the contact-making arrangement 10 is screwed to the bolt 74. In this case, it is preferable for a protective cap that is not illustrated, for example in the form of a plastic nut, to have been screwed onto the bolt 74, which is removed before the nut 12 is screwed on. In this case, there is no need to make an electrical contact via the upper face of the flanged section 78. In fact, the electrical contact with the contact substrate 72 can be made via the contact section 87 and the threaded engagement between the threaded sections 82, 84 and via the bolt 74.

In one alternative embodiment, one of the threaded sections 82, 84 may be in the form of a self-tapping threaded section. The other threaded section is in this case in the form of a tappable threaded section. In this case, it is not absolutely essential to fit a plastic cap for protection of the externally threaded section 82 before the bolt 74 is painted together with the contact substrate 72. This is because an electrical contact can be made by virtue of the tapping threaded engagement even when the externally threaded section 82 (which may be in the form of a tappable or a tapping threaded section) is painted before the nut 12 is screwed on.

When the nut 12 is being screwed onto the bolt 74 there is in general a tendency for the connecting parts 16 to rotate as well. In general, this is undesirable and can be prevented by rotation protection. Rotation protection such as this may comprise, for example, a fixed mouth piece being provided on a screwdriving tool which is acting on the tool attachment section 84, provided with U-shaped recesses. These clasp the line sections 64 of connecting parts 16 and in consequence prevent these connecting parts from rotating during the screwing-on process. As an alternative to this, it is also possible to provide rotation protection between the holding part 14 and the bolt 74, for example by the latching webs 54 being of such a size that they act on the non-circular external circumference of the flanged section 78. In this case, rotation of the connecting parts 16 while the nut 12 is being screwed on is prevented by the connecting parts 16 making contact with the inner faces of the radial openings 52.

When using a self-tapping threaded section 82 or 84, it is also possible to carry out process monitoring by monitoring the torque which is applied by a screwdriving tool, to be precise with respect to the time and/or the respective rotation position. Since the time at which the self-tapping threaded section engages with the tappable threaded section can be detected because of the relatively high required torque, it is then possible to use the time duration and/or the rotation position and/or the number of revolutions to determine how many connecting parts 16 are being held between the contact section 87 and the upper face of the flanged section 78. Details relating to this are contained in German patent application DE 10 2007 057 082.3, which has been referred to above.

The following FIGS. 4 to 8 show alternative embodiments of contact-making arrangements 10 according to the invention, or of parts of them.

Their general design and their general method of operation correspond to those of the contact-making arrangement 10 shown in FIGS. 1 to 3. The same elements are therefore provided with the same reference numbers. The following text describes only the differences.

Figure 4:
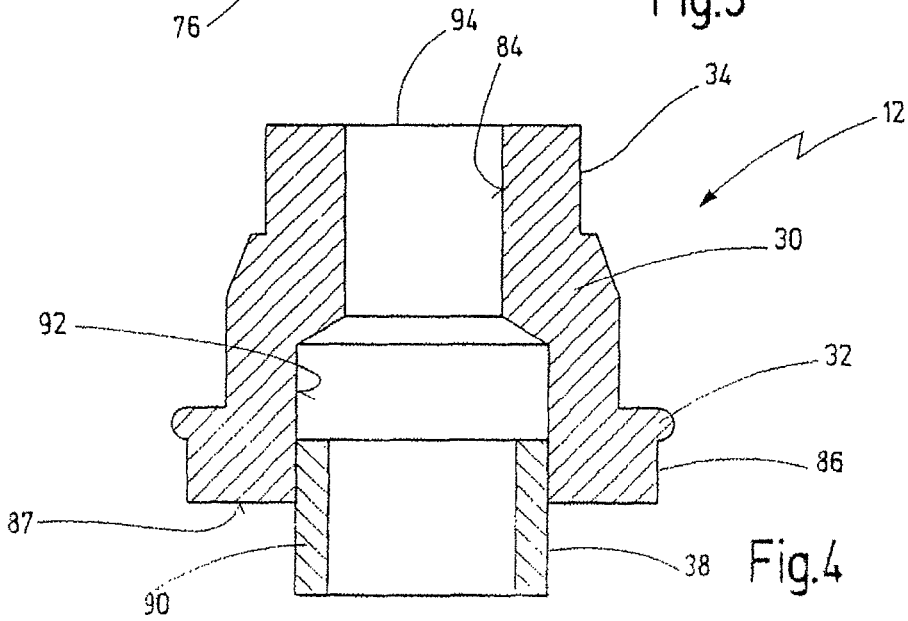
FIG. 4 shows a nut of a contact-making arrangement according to the invention, in the form of a longitudinal section with a modified centring section.

FIG. 4 shows an alternative embodiment of a nut 12 which has a centring section 38 in the form of a separate sleeve element 90, which is pressed into a hole 92 in the base body 30 of the nut 12. The sleeve element 90 is in this case pushed axially into the hole 92 when the nut 12 is screwed onto the bolt 74. If less than the maximum number of connecting parts 16 have been inserted into the connecting part holding section 24, the sleeve element 90 is moved into the hole 92 while the nut 12 is being screwed, until the connecting part or the connecting parts 16 is or are pressed between the contact section 87 and the upper face of the flanged section 78.

Figure 5:
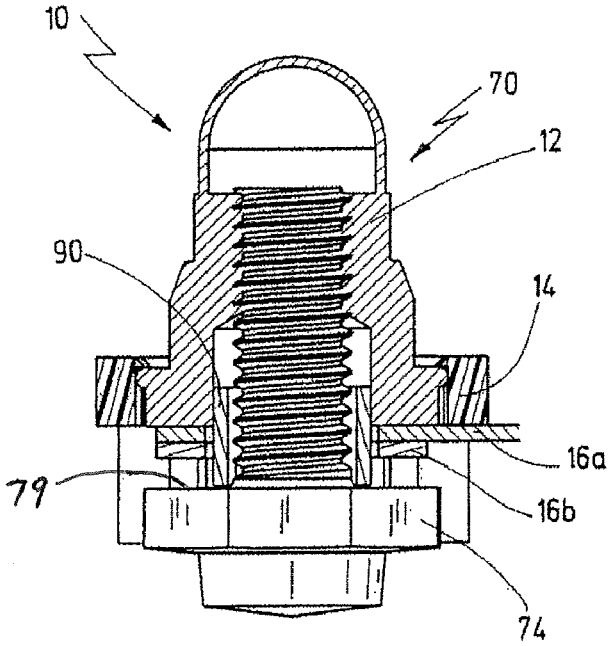
FIG. 5 shows an electrical contact shortly before completion, to be precise using a nut as shown in FIG. 4.
Figure 6:
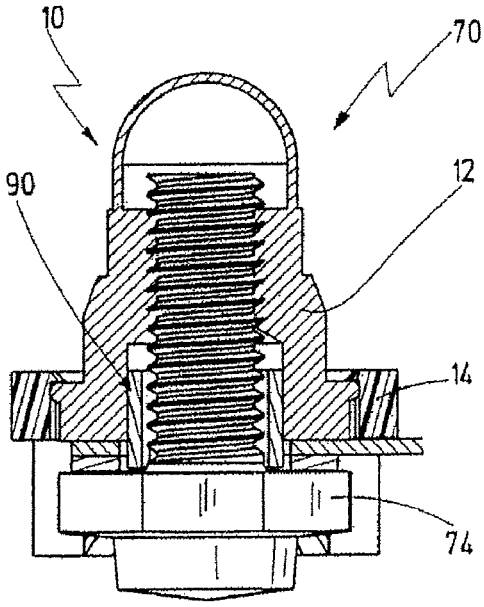
FIG. 6 shows the electrical contact shown in FIG. 5, after completion.

This is illustrated in FIGS. 5 and 6. FIG. 5 shows the contact-making arrangement 10 holding only two connecting parts 16*a*, 16*b*, even though three or four connecting parts 16 could be held in the contact-making arrangement 10. FIG. 5 shows a state in which the nut 12 has been screwed on until the lower face of the sleeve element 90 abuts against the upper face of the flanged section 78. The nut 12 is then screwed even further onto the bolt 74, with the sleeve element 90 being forced into the hole 92, until the state shown in FIG. 6 is reached, in which the contact section 87 presses the connecting parts 16 onto the upper face of the flanged section 78.

FIG. 4 also shows that the nut 12 need not necessarily be formed with a closure cap 36, but the internally threaded section 84 may be formed passing axially through the nut 12. The axial opening formed in this way is shown at 94.

Figure 7:
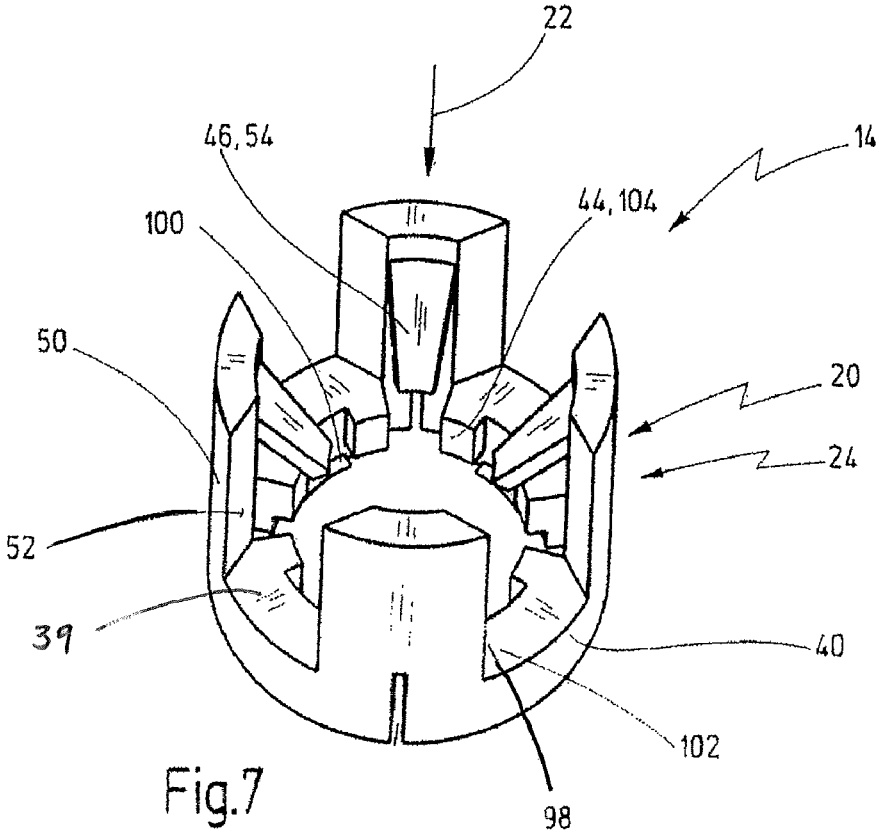
FIG. 7 shows a perspective view of an alternative embodiment of a holding part for a contact-making arrangement according to the invention.
Figure 8:
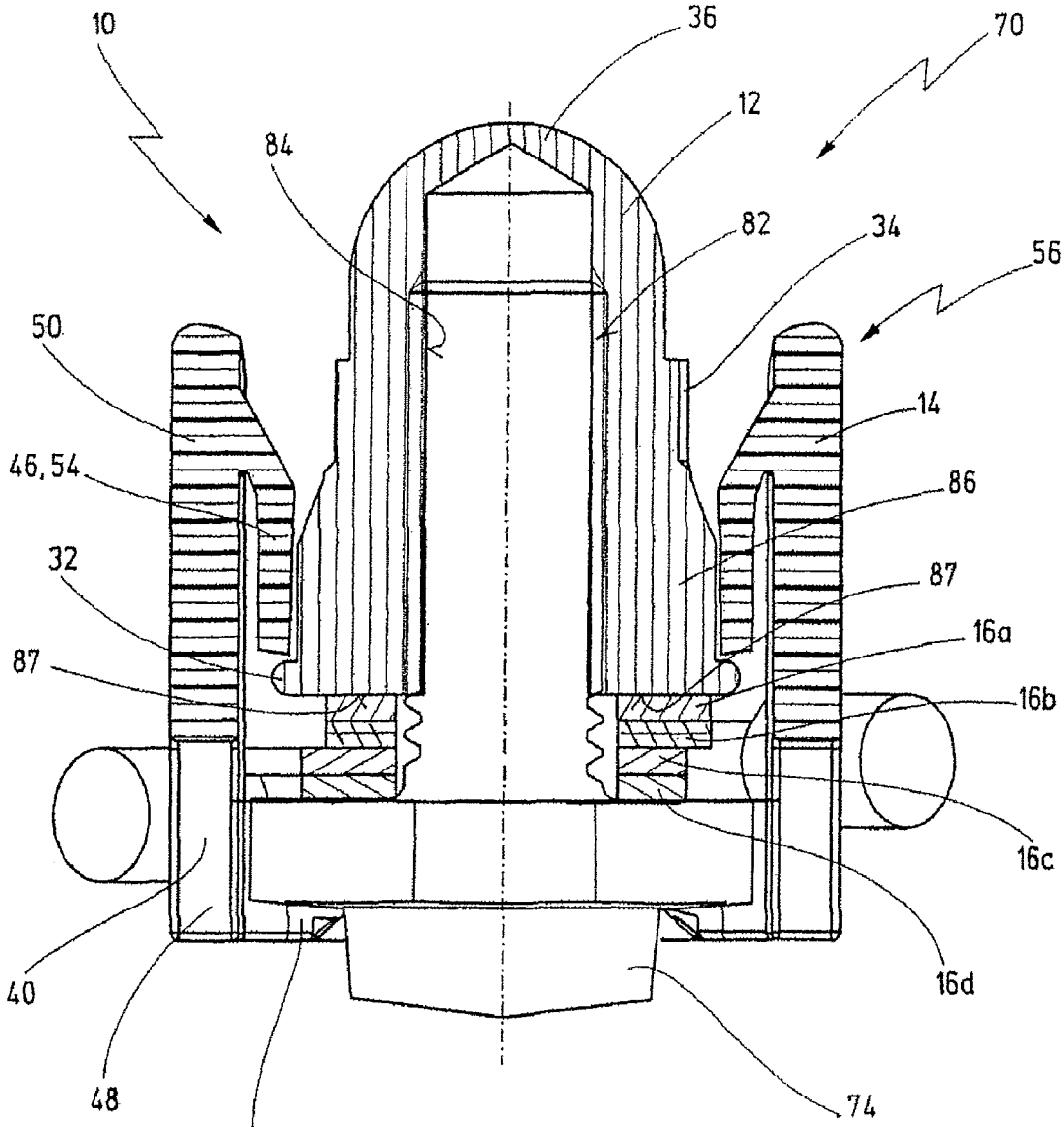
FIG. 8 shows a longitudinal section viewed through an electrical contact using a contact-making arrangement with a holding part as shown in FIG. 7.

FIGS. 7 and 8 show a further embodiment of a contact-making arrangement 10, with FIG. 7 showing the holding part 14 which is used for this purpose.

The holding part 14 has an annular body 40 which forms a base section 98 with an axial opening 42. A plurality of longitudinal webs 50 project from an upper face of the annular body 40. Latching tongues 46, 54 are formed on each of the inner faces of the longitudinal webs 50. The latching tongues 46, 54 form first and second latching means.

An upper face of the base section 98 forms an abutment surface 102.

In the holding part 14, a single holding section is formed between the longitudinal webs 50 and contains the nut holding section 20 and the connecting part holding section 24.

In the holding part 14, the contact sections 60 of the connecting parts 16 are first of all clipped into the holding section 20, 24 until the latching tongues 46, 54 engage behind the upper faces. Finally, as is shown in FIG. 8, the nut 12 is inserted into the same holding section 20, 24 until one end of the latching tongues 46, 54 engages behind the collar section 32 of the nut, as is illustrated in FIG. 8.

The nut of the contact-making arrangement 10 shown in FIG. 8 has no centring section underneath the contact section 87, but may be formed with one.

The base body 30 of the nut 12 is formed with an abutment section 86 which is provided above the collar section 32, in the axial direction. In this case, when the nut 12 has been inserted, the latching tongues 46, 54 rest radially on the abutment section 86, as is shown in FIG. 8.

As can also be seen from FIG. 7, the internal circumference of the annular body 40 may be formed with radial projections whose internal circumference forms a non-circular profile which is matched to the external circumference of the non-circular circumference of the flanged section 78. In consequence, the internal circumference of the annular body 40 and/or the internal circumference of the shoulder section 44 can form rotation protection.

A plurality of latching tongues 100 are formed at a lower end of the internal circumference of the annular body 40 and are designed to engage behind a lower face of the flanged section 78 of the bolt 74.

In consequence, in the case of the embodiment of the holding part 14 shown in FIG. 7, it is also possible for this first of all to be clipped onto the bolt 74 and then for the connecting parts 16 to be inserted into the holding section 20, 24. The nut 12 can then be screwed on. As an alternative to this, it is also possible for a cable fabricator to first of all clip the connecting parts 16 into the holding part 14 and then to clip the nut 12 into the holding part 14 in order in this way to form a preassembled contact-making unit 56, including the connecting parts 16. The preassembled contact-making unit 56 formed in this way can therefore be a component of a cable harness and can be brought to a final assembly point where the preassembled contact-making unit 56 is screwed in its entirety onto the bolt 74.

In this embodiment as well, one of the threaded sections 82, 84 may be in the form of a self-tapping threaded section (and the other as a tappable threaded section).

One or more features of the contact-making arrangement shown in FIGS. 7 and 8 may also be provided analogously for the contact-making arrangement shown in FIGS. 1 to 6.

Although exemplary embodiments of the present invention have been shown and described, it will be appreciated by those skilled in the art that changes may be made to these embodiments without departing from the principles and spirit of the invention, the scope of which is defined in the appended claims and their equivalents.

The invention claimed is:

1. A contact-making arrangement for establishing an electrical contact with a threaded grounding stud, the contact-making arrangement comprising:

a nut including a base body, partly defining an internally threaded section, and a collar section which projects radially beyond the base body;

at least one cable lug mountable coaxially on the grounding stud and securable to the grounding stud by the nut, and a holding part including a nut holding section, into which the nut can be inserted in a first axial direction, and a first latch which engages the collar section of the nut so that the nut is held rotable and axially captive within the holding part.

2. The contact-making arrangement according to claim 1, wherein the holding part further includes:

an annular body, and a connecting part holding section including at least two longitudinal webs extending from the annular body in the first axial direction, and the annular body and at least two longitudinal webs partly define radial openings open from a second axial direction opposite to the first axial direction.

3. The contact-making arrangement according to claim 2, wherein the connecting part holding section further includes a second latch, formed on at least one of the longitudinal webs, the second latch holding the cable lug axially within the connecting part holding section.

4. The contact-making arrangement according to claim 3, wherein the second latch extends radially inwards from the longitudinal web.

5. The contact-making arrangement according to claim 2, wherein the annular body partially defines at least one slot open from the first axial direction and extending axially into the annular body from a side which is opposite to the longitudinal webs.

6. The contact-making arrangement according to claim 2, wherein the holding part further includes a shoulder section located radially inward on the annular body, and the shoulder section acts as an axial stop for at least one of the nut and the cable lug, such that the shoulder section defines an axial boundary between the connecting part holding section and the nut holding section.

7. The contact-making arrangement according to claim 6, wherein:

the nut further includes an abutment section facing radially outward from the collar section of the nut;

the shoulder section of the holding part further includes a radially inward facing surface; and the abutment section of the nut is radially inward of the radially inward facing surface of the shoulder section of the holding part.

8. The contact-making arrangement according to claim 1, wherein the nut further includes a centring section which extends axially into the connecting part holding section.

9. The contact-making arrangement according to claim 8, wherein the centring section is formed integrally with the base body of the nut.

10. The contact-making arrangement according to claim 8, wherein the centring section is formed by a separate centring element, and the separate centring element is mounted axially movable on the base body of the nut.

11. The contact-making arrangement according to claim 10, wherein the separate centring element is in the form of a sleeve inserted into and axially movable within a hole defined in the base body.

12. The contact-making arrangement according to claim 1, wherein the cable lug is insertable into the holding part from a second axial direction opposite to the first axial direction.

13. The contact-making arrangement according to claim 2, wherein the annular body of the holding part includes an internal circumferential surface and the first latch extends radially inward of the inner circumferential surface.

14. The contact-making arrangement according to claim 2, with the nut holding section also forming the connecting part holding section.

15. The contact-making arrangement according to claim 14, wherein the holding part includes a base section with an axial opening, and the cable lug and the collar section of the nut are held axially captive between the base section and the first latch.

16. A preassembled electrical contact-making unit comprising:

a nut including a base body, partly defining an internally threaded section, and a collar section which projects radially beyond the base body; and a holding part including:

a nut holding section with an annular body;

a first latch projecting radially inward of the annular body; and a connecting part holding section including at least two longitudinal webs extending from the annular body in a first axial direction, and the annular body and at least two longitudinal webs partly define radial openings open from a second axial direction opposite to the first axial direction; and the nut is mounted within the nut holding section and the first latch engages the collar section of the nut so that the nut is held rotable and axially captive within the holding part.

17. A method for forming an electrical contact between at least one grounding cable lug and a grounding bolt connected to a contact substrate, such as a metal sheet, the grounding bolt including a shank with an external thread, and the method for forming the electrical contact comprises the steps of:

providing a preassembled electrical contact-making unit including:

a nut including a base body, partly defining an internally threaded section, and a collar section which projects radially beyond the base body; and a holding part including:

a nut holding section with an annular body;

a first latch projecting radially inward of the annular body; and a connecting part holding section including at least two longitudinal webs extending from the annular body in a first axial direction, and the annular body and at least two longitudinal webs partly define radial openings open from a second axial direction opposite to the first axial direction; and the nut is mounted within the nut holding section and the first latch engages the collar section of the nut so that the nut is held rotatable and axially captive within the holding part, inserting in the second axial direction the grounding cable lug into the connecting part holding section of the holding part;

fitting the combined contact-making unit and grounding cable lug on to the bolt such that the shank of the bolt passes through an opening in the grounding cable lug; and screwing the nut onto the bolt to form an electrical contact between the grounding cable lug and the bolt.

* * * * *